US007497601B2

(12) United States Patent
Uke

(10) Patent No.: US 7,497,601 B2
(45) **Date of Patent: *Mar. 3, 2009**

(54) LIGHTING SYSTEM AND METHOD AND REFLECTOR FOR USE IN SAME

(75) Inventor: Alan Uke, Del Mar, CA (US)

(73) Assignee: Underwater Kinetics, Inc., Poway, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/856,663

(22) Filed: Sep. 17, 2007

(65) Prior Publication Data

US 2008/0013321 A1 Jan. 17, 2008

Related U.S. Application Data

(63) Continuation of application No. 11/061,264, filed on Feb. 17, 2005, now Pat. No. 7,270,449.

(51) Int. Cl.
*F21V 7/00* (2006.01)

(52) U.S. Cl. ..... 362/350; 362/297; 362/346; 362/517; 362/518

(58) Field of Classification Search ..... 362/297, 362/346, 350, 517, 518
See application file for complete search history.

(56) References Cited

U.S. PATENT DOCUMENTS 4,788,633 A 11/1988 Zimmermann et al.
6,203,176 B1 3/2001 Gordin
6,206,549 B1 3/2001 Li
6,454,433 B1 9/2002 Alessio
6,485,160 B1 11/2002 Sommers et al.
6,502,952 B1 1/2003 Hartley
6,644,841 B2 11/2003 Martineau
6,672,741 B1 1/2004 Young
7,021,797 B2 4/2006 Minano et al.
7,040,782 B2 5/2006 Mayer
7,270,449 B2 * 9/2007 Uke ..... 362/350
2005/0185409 A1 * 8/2005 Mayer ..... 362/350

* cited by examiner

*Primary Examiner*—Sandra L. O'Shea
*Assistant Examiner*—Meghan K. Dunwiddie
(74) *Attorney, Agent, or Firm*—BioTechnology Law Group; Daniel M. Chambers

(57) ABSTRACT

Systems, methods and devices for lighting are provided with a reflector with paraboloidal segments. One lighting system includes a reflector having one or more reflector segments. Each reflector segment is substantially paraboloidal and has a central axis of symmetry. The lighting system also includes an illumination portion having one or more light sources. Each light source corresponds to one of the reflector segments and has a central illumination axis. The central illumination axis is directed toward the corresponding segment and substantially perpendicular to the central axis of symmetry of the corresponding segment.

20 Claims, 2 Drawing Sheets

LIGHTING SYSTEM AND METHOD AND REFLECTOR FOR USE IN SAME

CROSS-REFERENCE TO RELATED PATENT APPLICATIONS

The present application is a continuation of U.S. patent application Ser. No. 11/061,264, filed Feb. 17, 2005, titled LIGHTING SYSTEM AND METHOD AND REFLECTOR FOR USE IN SAME, which is hereby incorporated by reference in its entirety and for all purposes.

BACKGROUND OF THE INVENTION

The present invention relates generally to the field of lighting systems. In particular, the invention relates to a lighting system providing improved illumination.

Conventional lighting systems generally include a light source, such as a light bulb, and a reflector for directing the light in a desired direction. A typical light bulb distributes the light in a spherical pattern. In order to focus the light in a desired direction, conventional lighting systems use a reflector positioned behind the light source to reflect the light from one half of the spherical pattern. However, the reflected light and the direct light from the non-reflected half of the spherical pattern can still be substantially dispersed.

Thus, it is desirable to provide a lighting system which allows for more efficient direction of light.

SUMMARY OF THE INVENTION

The disclosed embodiments of the invention provide systems, methods and devices for lighting. Devices according to embodiments of the invention include a reflector with paraboloidal segments. A light source, such as an LED, is positioned such that the light from the light source is directed sideways onto the reflector. Thus, substantially all of the light from the light source strikes a surface of the reflector. When the light source is positioned at or near the focus of the paraboloidal segment, the light is reflected in a substantially parallel beam.

In one aspect, the invention includes a lighting system including a reflector having one or more reflector segments. Each reflector segment is substantially paraboloidal and has a central axis of symmetry. The lighting system also includes an illumination portion having one or more light sources. Each light source corresponds to one of the reflector segments and has a central illumination axis. The central illumination axis is directed toward the corresponding segment and substantially perpendicular to the central axis of symmetry of the corresponding segment.

A "reflector" includes a surface adapted to reflect light. A reflector may be made of a variety of materials, including metals.

A "reflector segment" is a reflector or a portion of a reflector with a substantially continuous surface. As used herein, a "reflector segment" includes a partial paraboloid. The partial paraboloid may include a portion of the paraboloid formed by up to 270 degrees of revolution, and in a particular embodiment, between about 90 and about 180 degrees of revolution.

As used herein, "paraboloidal" refers to having a three-dimensional shape that is part of a paraboloid. A paraboloid is a surface of revolution of a parabola about a central axis of symmetry. A paraboloid has the useful property of being able to convert a diverging light beam from a light source at its focus into a parallel beam.

A "central axis of symmetry" is an axis about which a parabola is revolved to produce a paraboloid.

A "light source" may be a light bulb, light-emitting diode or other element adapted to produce light.

A "central illumination axis" refers to a central line of a light beam from a light source. Thus, for example, for light sources having a hemispherical distribution of light, the central illumination axis may run through the spherical center and the apex of the hemisphere.

As used herein, "substantially perpendicular" refers to intersecting at approximately 90 degrees. In this regard, "substantially perpendicular" may include angles between 60 and 120 degrees. In a particular embodiment, "substantially perpendicular" includes angles between 70 and 110 degrees and, more particularly, between 80 and 100 degrees.

In one embodiment, each light source is positioned at a focus of the corresponding reflector segment.

A "focus" is the point within a paraboloid at which parallel lines striking and reflecting from the surface of the paraboloid intersect.

In one embodiment, each light source includes a light-emitting diode (LED).

The reflector may include two or more reflector segments forming a closed reflector. In one embodiment, the reflector includes three reflector segments. In a particular embodiment, the axis of symmetry of each reflector segment is offset from a central reflector axis of the closed reflector.

As used herein, "closed reflector" refers to a reflector with substantially paraboloidal segments positioned adjacent to each other to form a reflector having a closed cross section.

As used herein, "offset" refers to having a distance between substantially parallel axes.

A "central reflector axis" may be an axis along the weighted center of the closed reflector.

The reflector may include two or more reflector segments forming one or more reflector arrays. In one embodiment, each reflector array is a linear array. In a particular embodiment, two or more reflector arrays are arranged to form a reflector matrix.

An "array" refers to a series of one or more reflector segments.

A "linear array" is an array in which the reflector segments are aligned along a substantially straight line.

A "matrix" is an array of arrays.

In another aspect of the invention, a lighting method includes providing a reflector having one or more reflector segments. Each reflector segment is substantially paraboloidal and has a central axis of symmetry. The method also includes positioning a light source with a central illumination axis of the light source directed toward one of the reflector segments and substantially perpendicular to the central axis of symmetry of the reflector segment. The positioning a light source is repeated, if necessary, for each additional reflector segment.

In another aspect, a reflector for a lighting system includes two or more reflector segments. Each reflector segment is substantially paraboloidal and has a central axis of symmetry. The reflector segments are arranged to from a closed reflector.

DETAILED DESCRIPTION OF THE PREFERRED EMBODIMENTS

Figure 2:
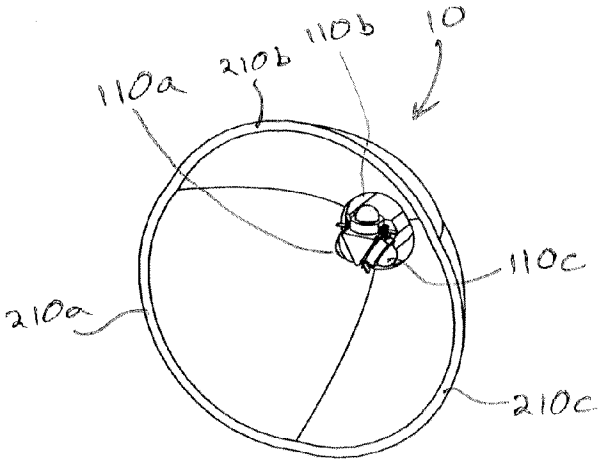
FIG. 2 illustrates a perspective view of the lighting system of FIG. 1 in an assembled configuration.
Figure 1:
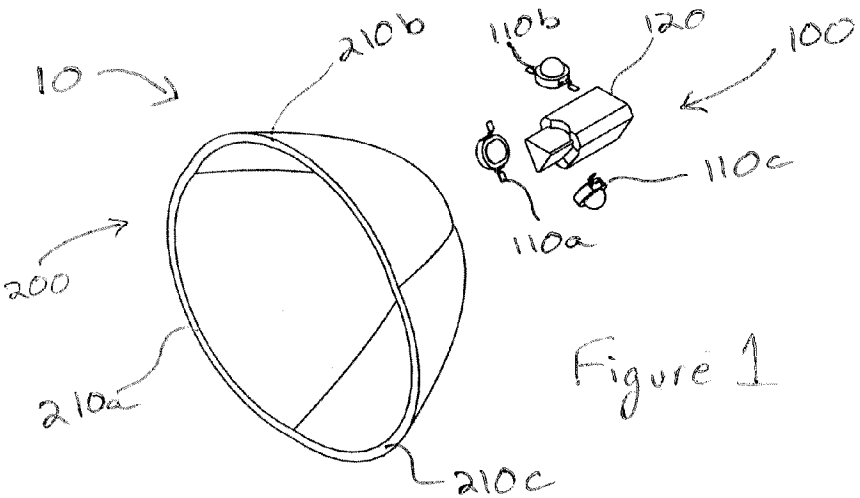
FIG. 1 is an exploded perspective view of an embodiment of a lighting system according to the present invention.

Referring to FIG. 1-4, an embodiment of a lighting system 10 is illustrated. The lighting system 10 includes an illumination portion 100 and a reflector 200. The illumination portion 100 includes a base 120 and light sources 110*a-c*. The base 120 provides for the mounting of the light sources 110*a-c* thereon and may provide for appropriate electrical connections to control and provide power to the light sources 110*a-c*. Power may be supplied from, for example, a battery or an electric outlet. The base may be formed of an insulated material, such as a substrate, with electrical connections embedded within or positioned on the surface.

The embodiment of the lighting system illustrated in FIGS. 1-4 includes three light sources 110*a-c*, and the base 120 is configured in a substantially triangular configuration to support the three light sources 110*a-c*. In other configurations, a different number of light sources may be used with an appropriate configuration of the base. Further, as described below, a corresponding configuration of the reflection 200 may be used.

As noted above, the illustrated embodiment of the illumination system 100 is provided with three light sources 110*a-c*. The light sources 110*a-c* may include electrical leads to make electrical connection with control and power contacts on the base 120. In one embodiment, the light sources 110*a-c* are light-emitting diodes (LED's). LED's typically distribute light in a substantially hemispherical pattern. Each LED light source 110*a-c* has a central illumination axis 130 (FIG. 4), which is a central line of the light beam from the LED light source 110*a-c*. For light sources having a hemispherical distribution of light, such as LED's, the central illumination axis 130 typically runs through the spherical center and the apex of the hemisphere.

Figure 4:
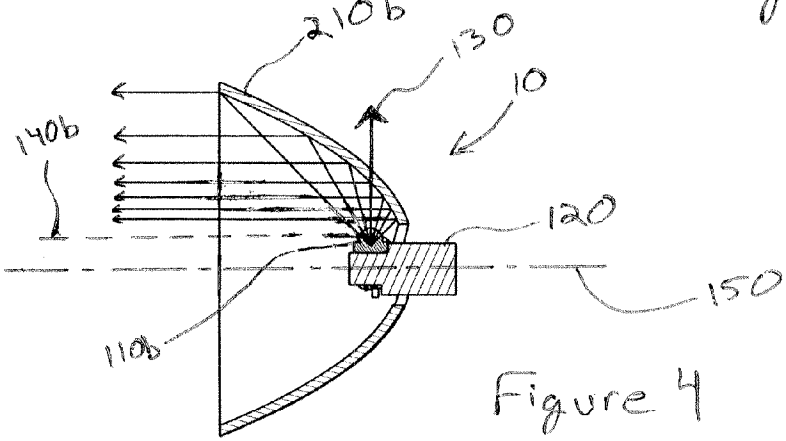
FIG. 4 is cross-sectional view of the lighting system of FIGS. 1-3 taken along IV-IV.
Figure 3:
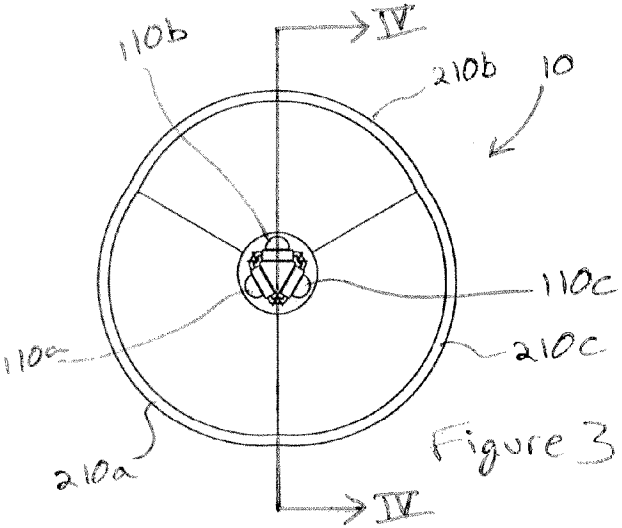
FIG. 3 illustrates a frontal plan view of the lighting system of FIG. 1.

The reflector 200 is provided with one or more reflector segments 210*a-c*. In the embodiment illustrated in FIGS. 1-4, the reflector 200 is provided with three reflector segments 210*a-c*, each corresponding to a light source 110*a-c*. The reflector 200 includes a surface adapted to reflect light and may be made a variety of materials, including metals such as aluminum. Each reflector segment 210*a-c* is a reflector or a portion of a reflector with a substantially continuous surface. Each reflector segment 210*a-c* is substantially paraboloidal and includes a partial paraboloid. A paraboloidal shape is a three-dimensional shape that is part of a paraboloid, which is a surface of revolution of a parabola about a central axis of symmetry about which a parabola is revolved to produce a paraboloid. As illustrated in FIG. 4, each paraboloidal reflector segment 210*b* corresponds to a central axis of symmetry 140*b*.

In various embodiments, each paraboloidal reflector segment 210*a-c* may include a portion of a paraboloid formed by up to 270 degrees of revolution. For an LED, a reflector segment formed by between about 90 and 180 degrees of revolution may be desired. In the embodiment illustrated in FIGS. 1-4 with three light sources 110*a-c* and three reflector segments 210*a-c*, each reflector segment 210*a-c* may be formed by between 120 and 135 degrees of revolution.

Thus, each light source 110*a-c* corresponds to one of the reflector segments 210*a-c*. In particular embodiments, each light source 110*a-c* is positioned substantially at the focus of the corresponding paraboloidal reflector segment 210*a-c*. The focus is the point within a paraboloid at which parallel lines striking and reflecting from the surface of the paraboloid intersect.

The central illumination axis 130 of each light source 110*a-c* is directed toward the corresponding reflector segment 210*a-c* and substantially perpendicular to the central axis of symmetry 140*b* of the corresponding reflector segment 210*a-c*. Thus, each light source 110*a-c* is positioned such that the angle between the central illumination axis 130 and the central axis of symmetry 140*b* is approximately 90 degrees, which may include angles between 60 and 120 degrees and, in particular, between 70 and 110 degrees or, more particularly, between 80 and 100 degrees.

In certain embodiments, such as that illustrated in FIGS. 1-4, the reflector 200 may include two or more reflector segments 210*a-c* forming a closed reflector. In the specific embodiment illustrated in FIGS. 1-4, the reflector 200 includes three reflector segments 210*a-c*. As noted above, each reflector segment 210*a-c* may include a portion of a paraboloid formed by up to 270 degrees of revolution. In the case of a reflector 200 formed of three reflector segments 210*a-c*, each reflector segment 210*a-c* may be formed by approximately 130 degrees of revolution. In this regard, the axis of symmetry 140*b* of each reflector segment 210*a-c* is offset from a central reflector axis 150 of the closed reflector 200. In the illustrated embodiment, the central reflector axis 150 runs through the center of weighted center of the closed reflector 200, as well as through the center of the base 120, while the axis of symmetry 140*b* of each reflector segment 210*a-c* runs through the corresponding light source 110*a-c*, or the focus.

Figure 5:
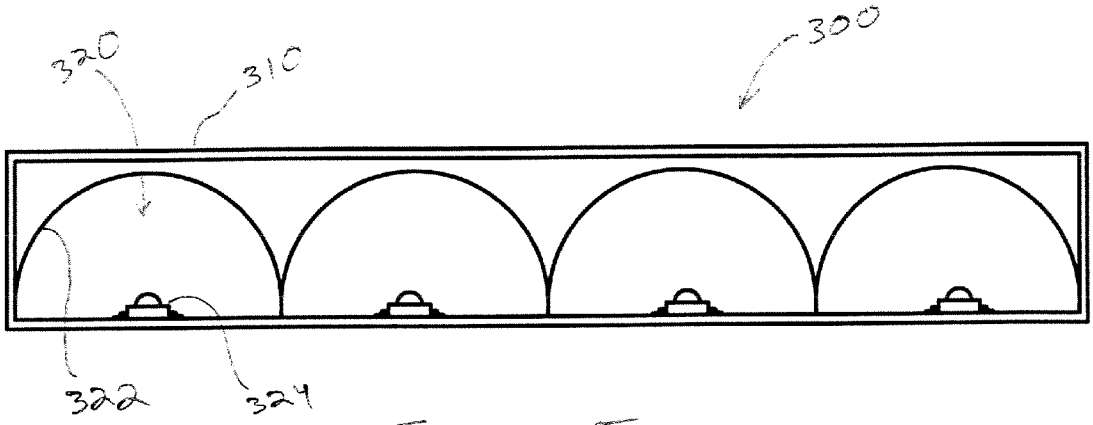
FIG. 5 is a plan view of another embodiment of a lighting system.
Figure 6:
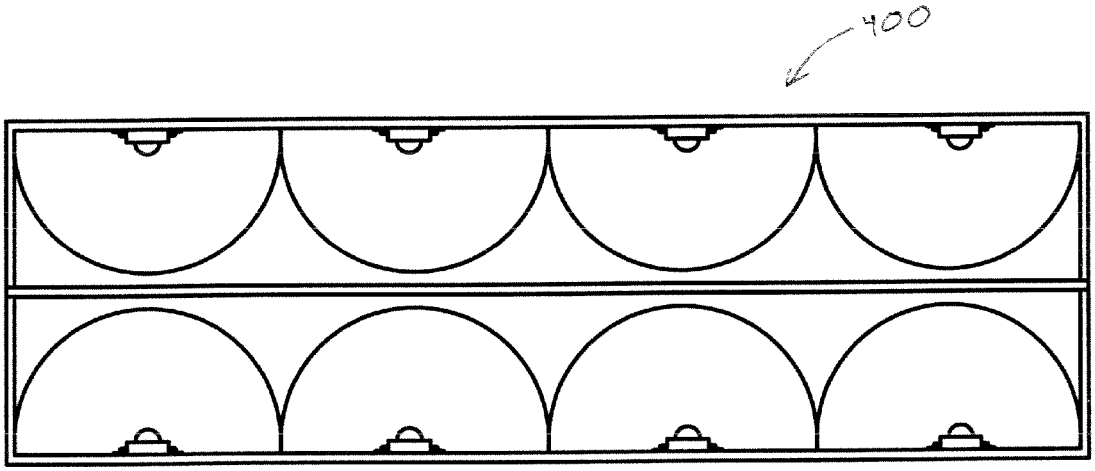
FIG. 6 is a plan view of still another embodiment of a lighting system.

In other embodiments, the reflector may include two or more reflector segments forming one or more reflector arrays. Two such embodiments are illustrated in FIGS. 5 and 6. Referring first to FIG. 5, a lighting system 300 is illustrated as having a lighting arrangement 320 positioned within a housing 310. The lighting arrangement 320 includes a series of paraboloidal reflector segments 322 arranged in an array. In the embodiment illustrated in FIG. 5, the reflector array is a linear array with the reflector segments 322 positioned along a straight line. Each reflector segment 322 is provided with a corresponding light source 324, such as an LED.

In another embodiment, as illustrated in FIG. 6, a lighting system 400 may be provided with two or more reflector arrays arranged to form a reflector matrix. Thus, a two-dimensional matrix is formed of two arrays, each array consisting of four reflector segments.

The foregoing description of embodiments of the invention have been presented for purposes of illustration and description. It is not intended to be exhaustive or to limit the invention to the precise form disclosed, and modifications and variation are possible in light of the above teachings or may be acquired from practice of the invention. The embodiment was chosen and described in order to explain the principles of the invention and its practical application to enable one skilled in the art to utilize the invention in various embodiments and with various modification as are suited to the particular use contemplated. It is intended that the scope of the invention be defined by the claims appended hereto and their equivalents.

What is claimed is:

1. A lighting system, comprising:

a closed reflector formed from one or more reflector segments, each reflector segment being substantially paraboloidal and having a central axis of symmetry; and positioned substantially at the center of the closed reflector, an illumination portion having one or more light sources, each light source corresponding to one of the reflector segments and having a central illumination axis wherein the central illumination axis of a light source is directed toward the corresponding reflector segment and is substantially perpendicular to the central axis of symmetry of the corresponding reflector segment.

2. A system according to claim 1, wherein each light source includes a light-emitting diode (LED).

3. A system according to claim 1, wherein the closed reflector includes two or more reflector segments forming one or more reflector arrays.

4. A system according to claim 3, wherein each reflector array is a linear array.

5. A system according to claim 1 comprising a plurality of closed reflectors disposed in at least two reflector arrays, wherein at least two of the reflector arrays are arranged to form a reflector matrix.

6. A system according to claim 1, wherein each light source is positioned substantially at the focus of the corresponding paraboloidal reflector segment.

7. A system according to claim 6, wherein each light source is directed toward the corresponding reflector segment, optionally substantially perpendicular to the central axis of symmetry of the corresponding reflector segment.

8. A method of assembling a lighting system, comprising:

a) providing a closed reflector having one or more reflector segments, each reflector segment being substantially paraboloidal and having a central axis of symmetry;

b) positioning a light source substantially at the center of the closed reflector with a central illumination axis of the light source directed toward one of the reflector segments and substantially perpendicular to the central axis of symmetry of the reflector segment, wherein the light source is positioned at a focus of the corresponding reflector segment; and c) repeating step b), if necessary, for each additional reflector segment.

9. A method according to claim 8, wherein each light source includes a light-emitting diode (LED).

10. A system according to claim 8, wherein the reflector includes two or more reflector segments forming one or more reflector arrays.

11. A system according to claim 10, wherein each reflector array is a linear array.

12. A system according to claim 8 comprising a plurality of closed reflectors disposed in at least two reflector arrays, wherein at least two of the reflector arrays are arranged to form a reflector matrix.

13. A closed reflector for a lighting system, wherein the closed reflector comprises two or more reflector segments each being substantially paraboloidal and having a central axis of symmetry, wherein the reflector segments are arranged to form a closed reflector having a central reflector axis from which each reflector segment central axis of symmetry is offset, and wherein the closed reflector is adapted to accommodate substantially at its center an illumination portion comprising one or more light sources.

14. A closed reflector according to claim 13 comprising 3 or 4 reflector segments, each of which is substantially paraboloidal and has a central axis of symmetry.

15. A closed reflector according to claim 13, wherein each substantially paraboloidalreflector segment is configured as a portion of a paraboloid formed by up to about 270 degrees of revolution about its central axis of symmetry.

16. A closed reflector according to claim 13 comprised of three reflector segments, wherein each reflector segment is configured as a portion of a paraboloid formed by between about 120 and about 135 degrees of revolution about its central axis of symmetry.

17. A closed reflector according to claim 13 comprised of three reflector segments, wherein each reflector segment is configured as a portion of a paraboloid formed by about 130 degrees of revolution about its central axis of symmetry.

18. A closed reflector according to claim 13, wherein each reflector segment is configured as a portion of a paraboloid formed by between about 90 and about 180 degrees of revolution about its central axis of symmetry.

19. A closed reflector according to claim 13, wherein the illumination portion for which the closed reflector is adapted to accommodate comprises a light-emitting diode (LED) for each light source.

20. A closed reflector according to claim 19, wherein the reflector segments are configured such that upon functional association with the illumination portion, each light-emitting diode (LED) is positioned at or near the focus of the corresponding reflector segment.

* * * * *

UNITED STATES PATENT AND TRADEMARK OFFICE

CERTIFICATE OF CORRECTION

PATENT NO. : 7,497,601 B2
APPLICATION NO. : 11/856663
DATED : March 3, 2009
INVENTOR(S) : Alan Uke It is certified that error appears in the above-identified patent and that said Letters Patent is hereby corrected as shown below:

Claim 1, Column 5, line 2:

~~Correction: Add [,] after axis as follows: reflector segments and having a central illumination axis[,]~~
Corrected line should read as follows: reflector segments and having a central illumination axis,

Claim 6, Column 5, lines 18, 19 and 20:

Correction: Delete claim 6 in it's entirety as follows: ~~A system according to claim 1, wherein each light source is positioned substantially at the focus of the corresponding paraboloidal reflector segment.~~
~~Add correct claim 6, as filed on in Response to Non-Final Office Action dated 06 AUG. 2008, as follows:~~
~~A method of assembling a lighting system, comprising:~~
~~a) providing a closed reflector having one or more reflector segments, each reflector segment being substantially paraboloidal and having a central axis of symmetry;~~
~~b) positioning a light source, substantially at the center of the closed reflector with a central illumination axis of the light source directed toward one of the reflector segments and substantially perpendicular to the central axis of symmetry of the reflector segment; wherein the light source is positioned at a focus of the corresponding reflector segment; and~~
~~c) repeating step b), if necessary, for each additional reflector segment.~~

Corrected claim 6 should read as follows:
A method of assembling a lighting system, comprising:
a) providing a closed reflector having one or more reflector segments, each reflector segment being substantially paraboloidal and having a central axis of symmetry;
b) positioning a light source substantially at the center of the closed reflector with a central illumination axis of the light source directed toward one of the reflector segments and substantially perpendicular to the central axis of symmetry of the reflector segment; wherein the light source is positioned at a focus of the corresponding reflector segment; and
c) repeating step b), if necessary, for each additional reflector segment.

Signed and Sealed this
Sixteenth Day of August, 2011

David J. Kappos

David J. Kappos
*Director of the United States Patent and Trademark Office*

Claim 7, Column 5, Lines 21, 22 23, and 24:

Correction: Delete claim 7 in it's entirety as follows:
~~A system according to claim 6, wherein each light source is directed toward the corresponding reflector segment, optionally substantially perpendicular to the central axis of symmetry of the corresponding reflector segment.~~
~~Add correct claim 7, as filed on in Response to Non-Final Office Action a light emitting diode (LED).~~

Corrected claim 7 should read as follows:
A method according to claim 6, wherein each light source includes a light-emitting diode (LED).

Claim 8, Column 5, Lines 25 through 37:

Correction: Delete claim 8 in it's entirety as follows:
~~A method of assembling a light system, comprising:~~
~~a) providing a closed reflector having one or more reflector segments, each reflector segment being substantially paraboloidal and having a central axis of symmetry;~~
~~b) positioning a light source substantially at the center of the closed reflector with a central illumination axis of the light source directed toward one of the reflector segments and substantially perpendicular to the central axis of symmetry of the reflector segment, wherein the light source is positioned at a focus of the corresponding reflector segment; and~~
~~c) repeating step b), if necessary, for each additional reflector segment.~~
~~Add correct claim 8, as filed on in Response to Non-Final Office action dated 06-AUG. 2008, as follows:~~

Corrected claim 8 should read as follows:
A system according to claim 6, wherein the reflector includes two or more reflector segments forming one or more reflector arrays.

Claim 9, Column 5, lines 38 and 39:

Correct as follows:
~~A method~~ ~~system~~ ~~according to claim 8, wherein each~~ ~~reflector array~~ ~~light source includes a light emitting diode (LED)~~ ~~is a linear array~~.

Corrected line should read as follows:
A system according to claim 8, wherein each reflector array is a linear array.

Claim 10, Column 5, lines 40 and 42:

Correct as follows:
~~A system according to claim 8~~ ~~6~~, ~~comprising a plurality of closed reflectors disposed in at least two~~ ~~reflector arrays~~, ~~wherein the reflector includes~~ ~~at least~~ ~~two~~ ~~of the~~ ~~or more reflector segments forming one or more reflector arrays~~ ~~are arranged to form a reflector matrix~~.

Corrected claim 10 should read as follows:
A system according to claim 6, comprising a plurality of closed reflectors disposed in at least two reflector arrays, wherein at least two of the reflector arrays are arranged to form a reflector matrix.

Claim 11, Column 5, lines 43 and 44:

~~Correct as follows:~~
~~A system according to claim 10 1, wherein each light source is positioned substantially at the focus of the corresponding paraboloidal reflector segment reflector array is a linear array.~~

Corrected line should read as follows:
A system according to claim 1, wherein each light source is positioned substantially at the focus of the corresponding paraboloidal reflector segment.

Claim 12, Column 6, lines 1, 2, 3, and 4:

~~Correct as follows:~~
~~A system according to claim 8 11, wherein each light source is directed toward the corresponding comprising a plurality of closed reflectors disposed in at least two reflector segment arrays, optionally substantially perpendicular to the central axis of symmetry of the corresponding reflector segment wherein at least two of the reflector arrays are arranged to form a reflector matrix.~~

Corrected claim 12 should read as follows:
A system according to claim 11, wherein each light source is directed toward the corresponding reflector segment, optionally substantially perpendicular to the central axis of symmetry of the corresponding reflector segment.

Claim 15, Column 6, line 18:

Correct as follows:
~~substantially paraboloidal[space]reflector segment is configured as a~~

Corrected line should read as follows:
substantially paraboloidal reflector segment is configured as a